US010256585B1

(12) United States Patent
Wierenga

(10) Patent No.: US 10,256,585 B1
(45) Date of Patent: Apr. 9, 2019

(54) MULTI-CONFIGURABLE ELECTRICAL CABLE ASSEMBLY

(71) Applicant: Griffin Technology, LLC, Irvine, CA (US)

(72) Inventor: Aaron Wierenga, Nashville, TN (US)

(73) Assignee: Griffin Technology, LLC, Irvine, CA (US)

( * ) Notice: Subject to any disclaimer, the term of this patent is extended or adjusted under 35 U.S.C. 154(b) by 0 days.

(21) Appl. No.: 15/727,534

(22) Filed: Oct. 6, 2017

(51) Int. Cl.

| | |
|---|---|
| ***H01R 9/03*** | (2006.01) |
| ***H01R 13/62*** | (2006.01) |
| ***H01R 13/64*** | (2006.01) |
| ***H01R 27/00*** | (2006.01) |
| ***H01R 31/00*** | (2006.01) |
| ***H01R 31/02*** | (2006.01) |
| ***H01R 31/06*** | (2006.01) |

(52) U.S. Cl.
CPC ..... *H01R 27/00* (2013.01); *H01R 13/62* (2013.01); *H01R 13/64* (2013.01); *H01R 31/005* (2013.01); *H01R 31/02* (2013.01); *H01R 31/065* (2013.01); *H01R 9/03* (2013.01)

(58) Field of Classification Search
CPC ..... H01R 35/04; H01R 31/06; H01R 27/00; H01R 23/025; H01R 13/62; H01R 13/64; H01R 31/065; H01R 31/02; H01R 31/005; H01R 9/03
USPC ..... 439/640, 131, 532, 534, 218, 502
See application file for complete search history.

(56) References Cited

U.S. PATENT DOCUMENTS 5,795,183 A * 8/1998 Kameyama ..... H01R 13/703 439/528
7,255,567 B1 * 8/2007 Liao ..... H01R 31/06 439/11

(Continued)

*Primary Examiner* — Gary F Paumen
(74) *Attorney, Agent, or Firm* — Manatt, Phelps & Phillips, LLP

(57) ABSTRACT

Multi-configurable electrical cable assemblies adapted to facilitate communication with and charging of electronic devices are disclosed. The cable assemblies comprises a cable extending from a first electrical connector to a second electrical connector and a yoke captively and slidably coupled to one end of the cable and rotatably coupled to an adaptor module at the other end. The adaptor module includes one or more electrical connector adaptors. The yoke can be extended or retracted and when the yoke is in an unconnected position, the adaptor module is rotatable to allow for selection of a desired electrical connector adaptor for connection to the cable. In one implementation, the cable extends from a male USB Type A connector to a male USB Micro connector, the yoke is captively coupled at the USB Micro connector end of the cable, and the rotatably coupled adaptor module includes two reversibly coupled electrical connector adaptors. The first electrical connector adaptor includes a female USB Micro connector on one side and a male Lightning connector electrically coupled thereto on the other side and the second electrical connector adaptor includes a female USB Micro connector on one side and a male USB Type-C connector electrically coupled thereto on the other side. The female USB Micro connectors are positioned in opposite directions and can mate with the male USB Micro connector on the end of the cable when rotated into alignment.

21 Claims, 12 Drawing Sheets

(56) References Cited

U.S. PATENT DOCUMENTS

| | | | | |
|---|---|---|---|---|
| 7,473,141 | B2 * | 1/2009 | Liao | H01R 13/62<br>439/638 |
| 7,556,535 | B2 * | 7/2009 | Liao | H01R 13/6273<br>439/640 |
| 8,550,828 | B2 * | 10/2013 | Liao | H01R 31/06<br>439/131 |
| 8,926,372 | B2 * | 1/2015 | McSweyn | H01R 27/02<br>439/640 |
| 2006/0073717 | A1 * | 4/2006 | Ng | H01R 35/04<br>439/131 |
| 2008/0050975 | A1 * | 2/2008 | Liao | H01R 13/62<br>439/660 |
| 2014/0170909 | A1 * | 6/2014 | Liao | H01R 13/447<br>439/730 |
| 2014/0273644 | A1 * | 9/2014 | McSweyn | H01R 27/00<br>439/628 |
| 2014/0322938 | A1 * | 10/2014 | Tseng | H01R 13/44<br>439/131 |
| 2016/0118758 | A1 * | 4/2016 | Cymerman | H01R 31/06<br>439/39 |

* cited by examiner

MULTI-CONFIGURABLE ELECTRICAL CABLE ASSEMBLY

INCORPORATION BY REFERENCE TO RELATED APPLICATIONS

N/A.

BACKGROUND

Field

This disclosure relates to accessories for electronic devices and more specifically to multi-configurable electrical cable assemblies adapted to interface with electronic devices.

Description of the Related Art

Electronic devices, such as computers, servers, smart and cellular phones, computing tablets, $MP^3$/audio/video players, gaming devices, laptops, battery and power chargers, and countless others are continuously and rapidly evolving to meet expanding consumer demand. It is not uncommon for such electronic devices to include one or more standardized or proprietary electrical interfaces or connectors for charging or powering the device and/or synchronizing or otherwise facilitating communication with the device.

For example, Universal Serial Bus (USB) is a well-known industry standard that was designed to replace a variety of earlier interfaces, such as serial ports, parallel ports, and power chargers, so as to standardize the communication and power connection of computer peripherals (including keyboards, pointing devices, digital cameras, printers, portable media players, disk drives and network adaptors) to personal computers. There are several formats of USB connectors, for example, Type-A, Type-A SuperSpeed, Type-B, Type-B SuperSpeed, Mini-A, Mini-B, Micro-A, Micro-B, Micro-B SuperSpeed, USB 3.0, USB 3.0 Micro B, USB 3.0 Micro AB, and Type-C. Each of these USB connectors are defined by standardized electrical male (e.g., plugs) and mating female (e.g., receptacles or jacks) connector configurations.

Another example is the Lightning® connector. The Lightning® connector is a proprietary computer bus and power connector created by Apple Inc. to connect Apple's mobile devices such as iPhones, iPads, and iPods to host computers, external monitors, cameras, USB battery chargers, and other peripherals.

A consumer or user of electronic devices often times is faced with the challenge of interfacing electronic devices that have dissimilar electrical interfaces or connectors. Carrying an array of cables with desired interfaces and/or an array of interface adaptors can be expensive and burdensome. Moreover, they can be easily misplaced or otherwise unavailable to the user when needed.

The inventors here have recognized that there is a continuing need, therefore, for a multi-configurable electrical cable assembly capable of facilitating communication with and charging of an electronic device.

SUMMARY

Disclosed are numerous aspects of a unique and inventive electrical cable assembly configurable to allow connectivity and/or power between electronic devices having dissimilar electrical interfaces. The cable assemblies generally comprise a cable extending from a first electrical connector to a second electrical connector and a yoke captively and slidably coupled to one end of the cable and rotatably coupled to an adaptor module at the other end. The adaptor module includes one or more electrical connector adaptors that can be selected by the user and aligned to connect to one or more of the electrical connectors on the cable to thereby adapt the cable with a different electrical connection. The configuration, construction, use and manufacture of the component elements and combinations thereof constitute separate aspects of the invention. Accordingly, it should be understood that each of the foregoing and various aspects, together with those set forth in the claims and summarized above and/or otherwise disclosed herein, including the drawings, may be combined to support claims for a device, apparatus, system, method of manufacture, and/or use without limitation.

BRIEF DESCRIPTION OF THE DRAWINGS

These and other features, aspects and advantages are described below with reference to the drawings, which are intended to illustrate, but not to limit, the invention. In the drawings, like reference characters denote corresponding features consistently throughout similar embodiments.

Figure 1A:
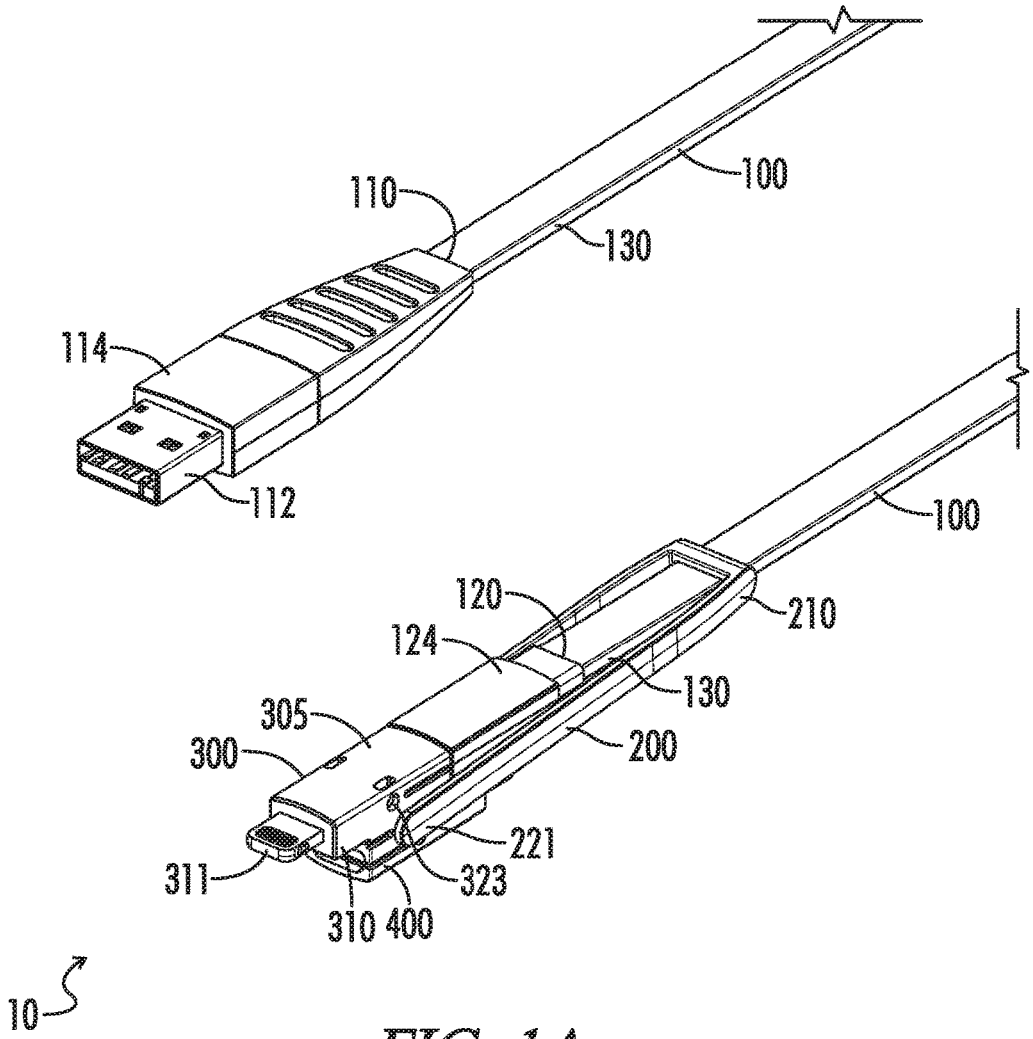
FIG. 1A is a perspective view of a multi-configurable electrical cable assembly comprising a cable, a yoke slidably coupled to the cable on one end, and an adaptor module having two different electrical connector adaptors and being rotatably coupled to the yoke at the other end. The yoke is in a connected position and one of the electrical connector adaptors is attached to a mating connector at the end of the cable. The illustration depicts two ends of the cable assembly without the mid-section of the cable, but it should be understood that the cable extends continuously from one end to the other end.
Figure 1B:
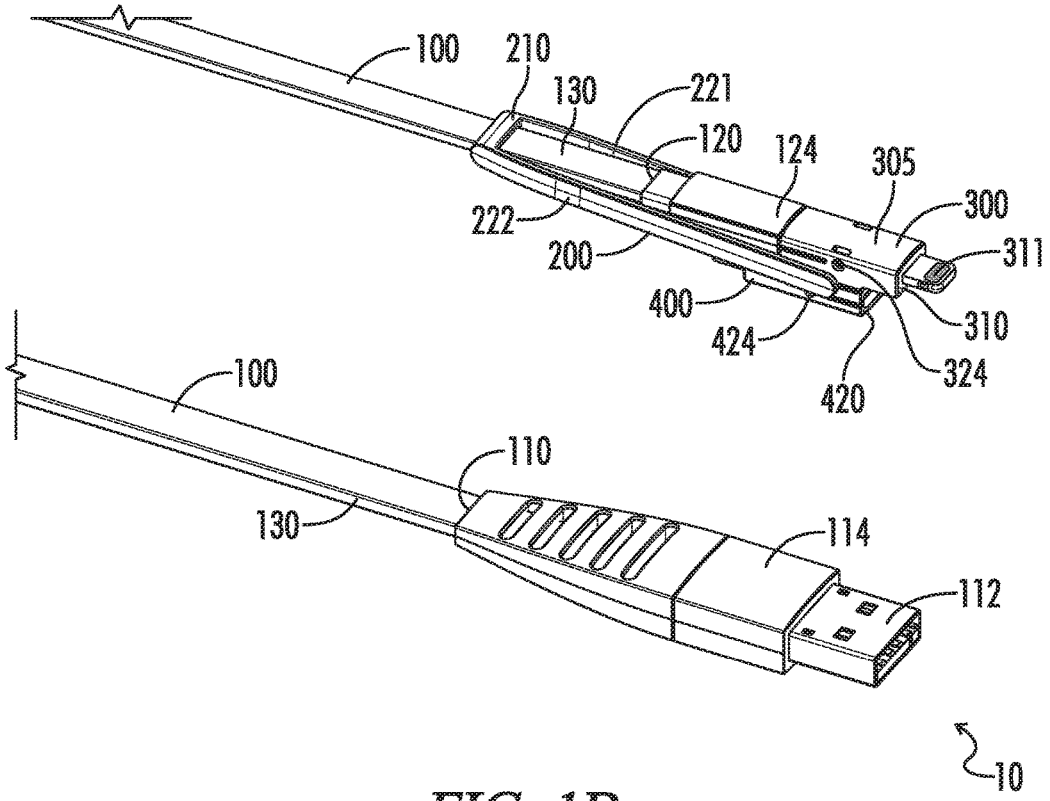
FIGS. 1B and 1C are alternate perspective and top views, respectively, of the multi-configurable electrical cable assembly of FIG. 1A.
Figure 1C:
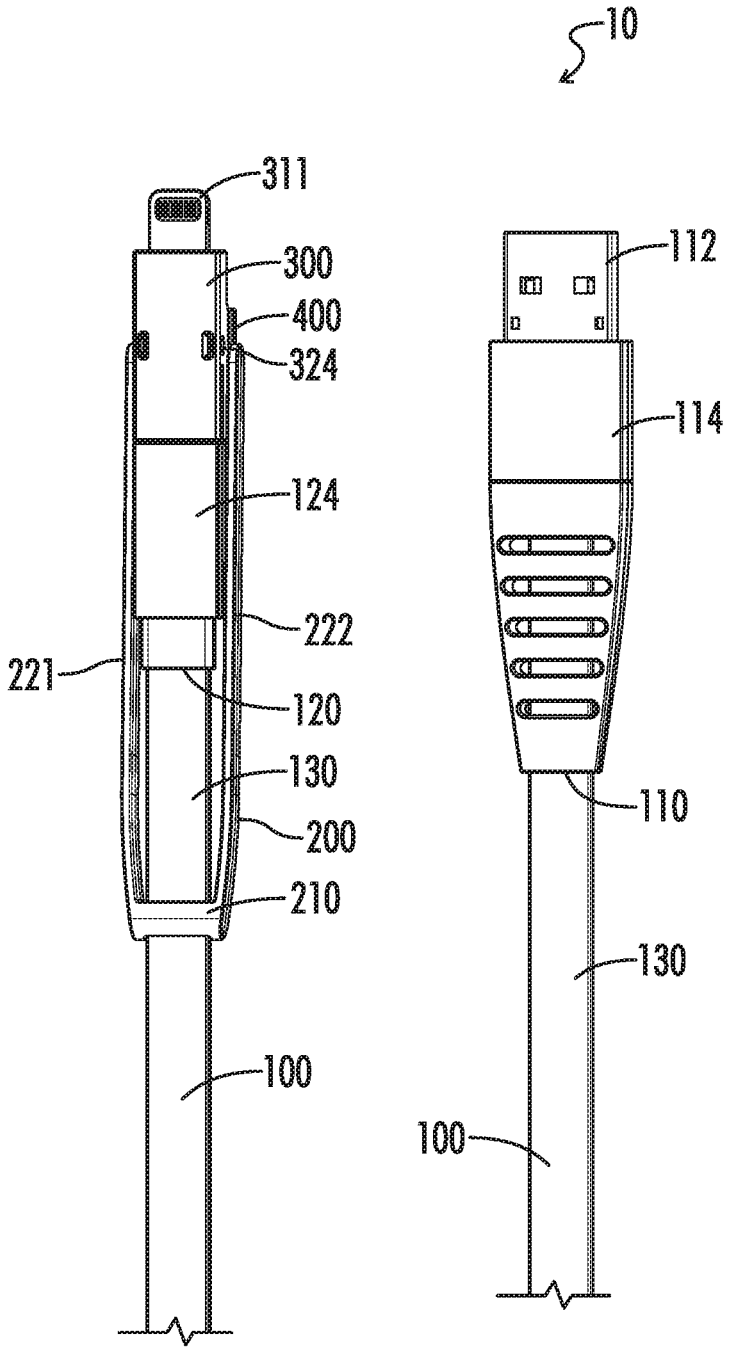
Figure 2A:
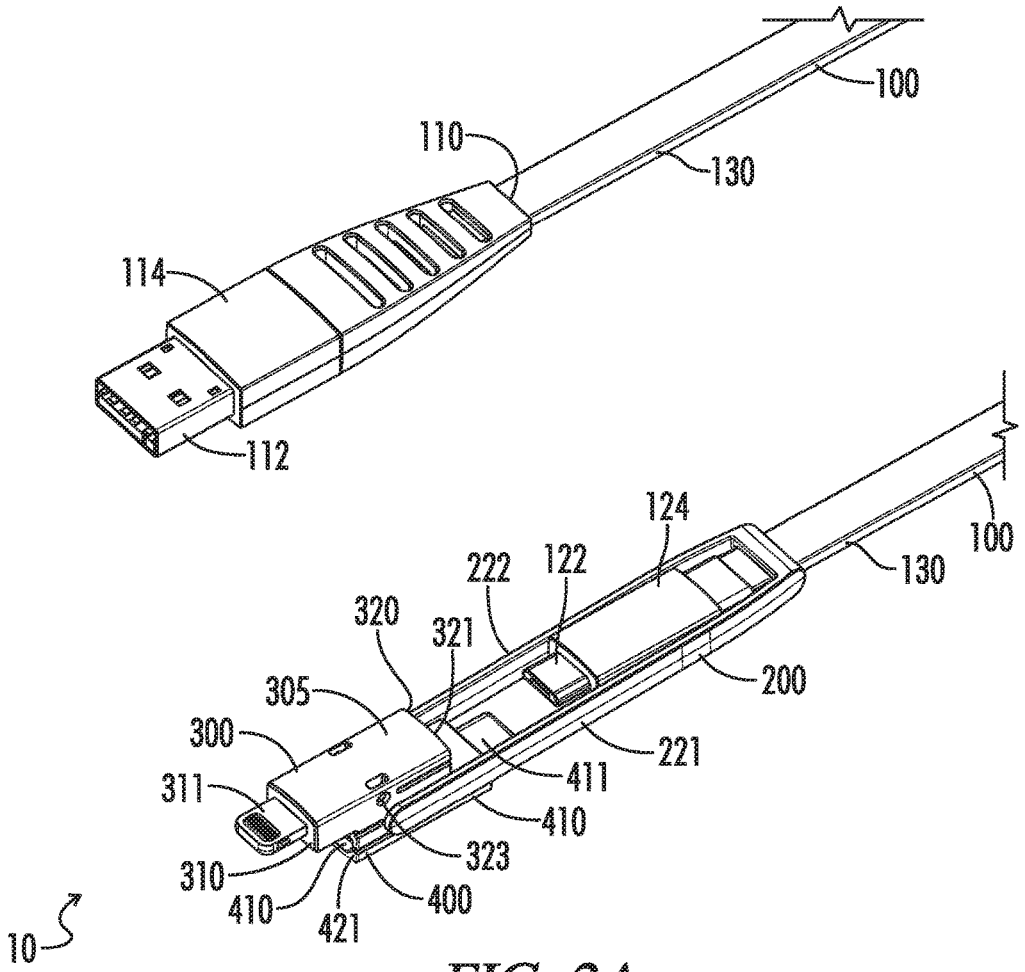
FIG. 2A is a perspective view of the multi-configurable electrical cable assembly of FIGS. 1A-C, wherein the yoke is depicted in an unconnected extended position and the electrical connector adaptor is detached from the mating connector at the end of the cable.
Figure 2B:
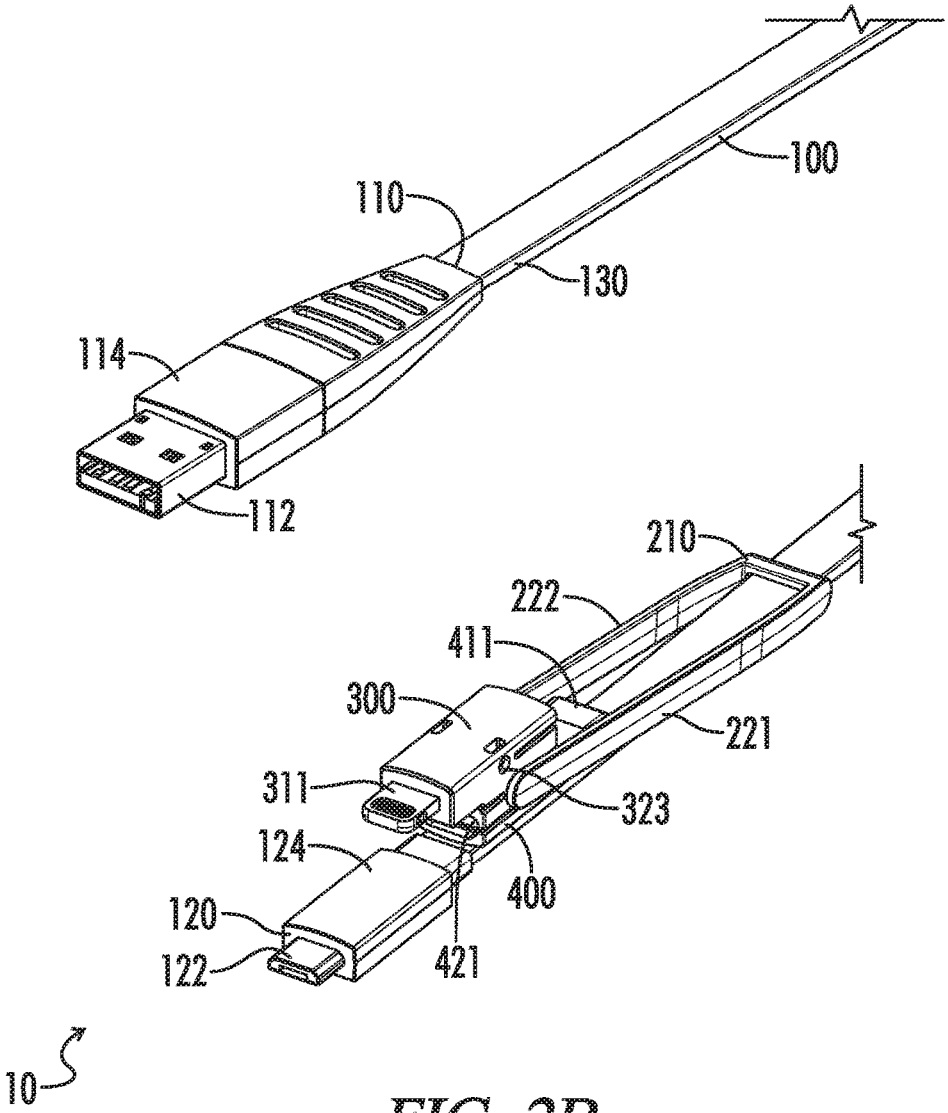
FIG. 2B is a perspective view of the multi-configurable electrical cable assembly of FIGS. 1A-C, wherein the yoke is depicted in an unconnected retracted position and the electrical connector adaptor is detached from the mating connector at the end of the cable.
Figure 3:
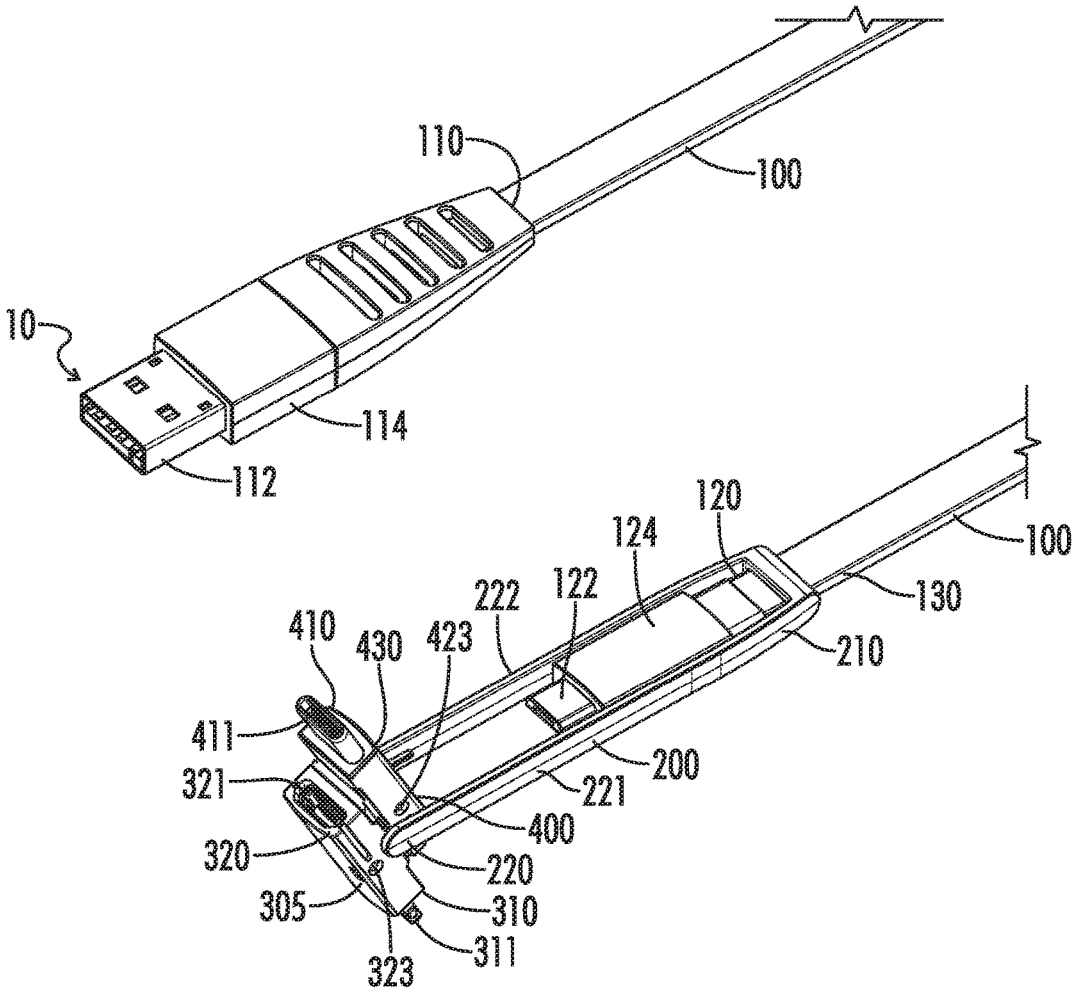
FIG. 3 is a perspective view of the multi-configurable electrical cable assembly of FIG. 1A-C, wherein the yoke is depicted in an unconnected extended position as illustrated in FIG. 2A, the electrical connector adaptor is detached from the mating connector at the end of the cable, and the adaptor module is rotated out of alignment from the mating connector.
Figure 4:
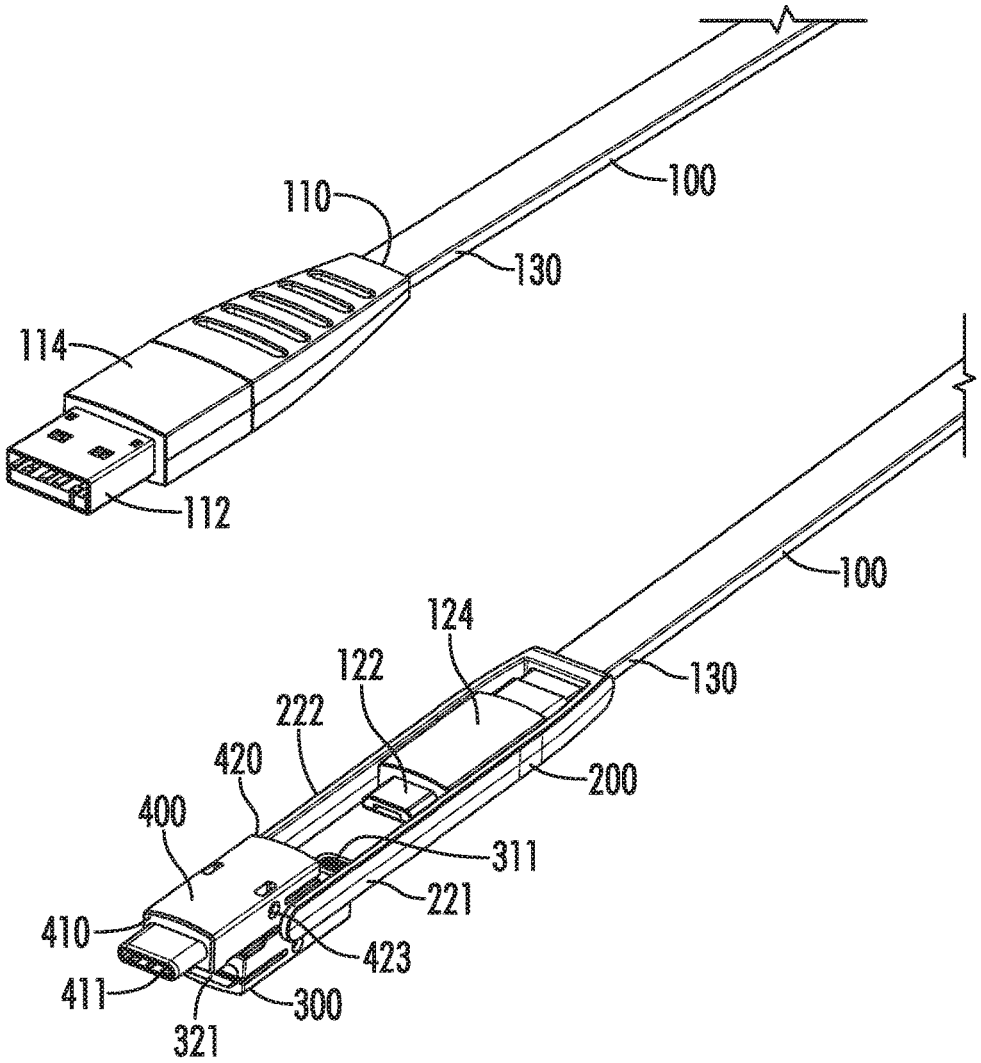
FIG. 4 is a perspective view of the multi-configurable electrical cable assembly of FIG. 1A-C, wherein the yoke is depicted in an unconnected extended position as illustrated in FIG. 2A and the electrical connector adaptor is rotated approximately 180 degrees and detached from the connector at the end of the cable.
Figure 5:
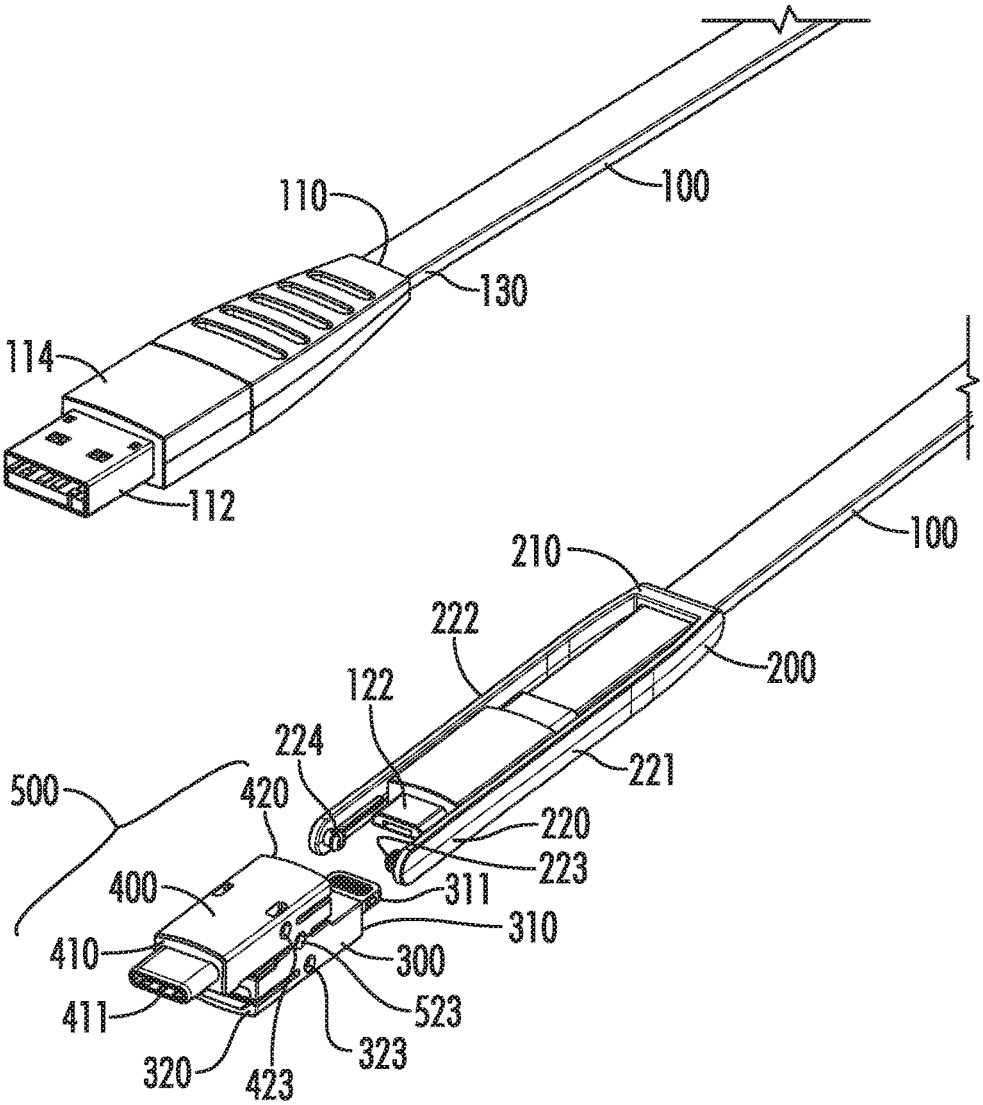
FIG. 5 is a perspective view of the multi-configurable electrical cable assembly of FIG. 1A-1C, wherein the adaptor module is rotated approximately 180 degrees and uncoupled from the yoke and the yoke is in the connected position (though the adaptor module is not actually connected to the mating connector).

Each drawing is generally to scale and hence relative dimensions of the various components can be determined from the drawings.

DETAILED DESCRIPTION OF THE PREFERRED EMBODIMENT

As summarized above and illustrated in the drawings, disclosed herein are various aspects of a protective case for a mobile device. Many of those aspects are summarized above and illustrated in the drawings.

Figure 6:
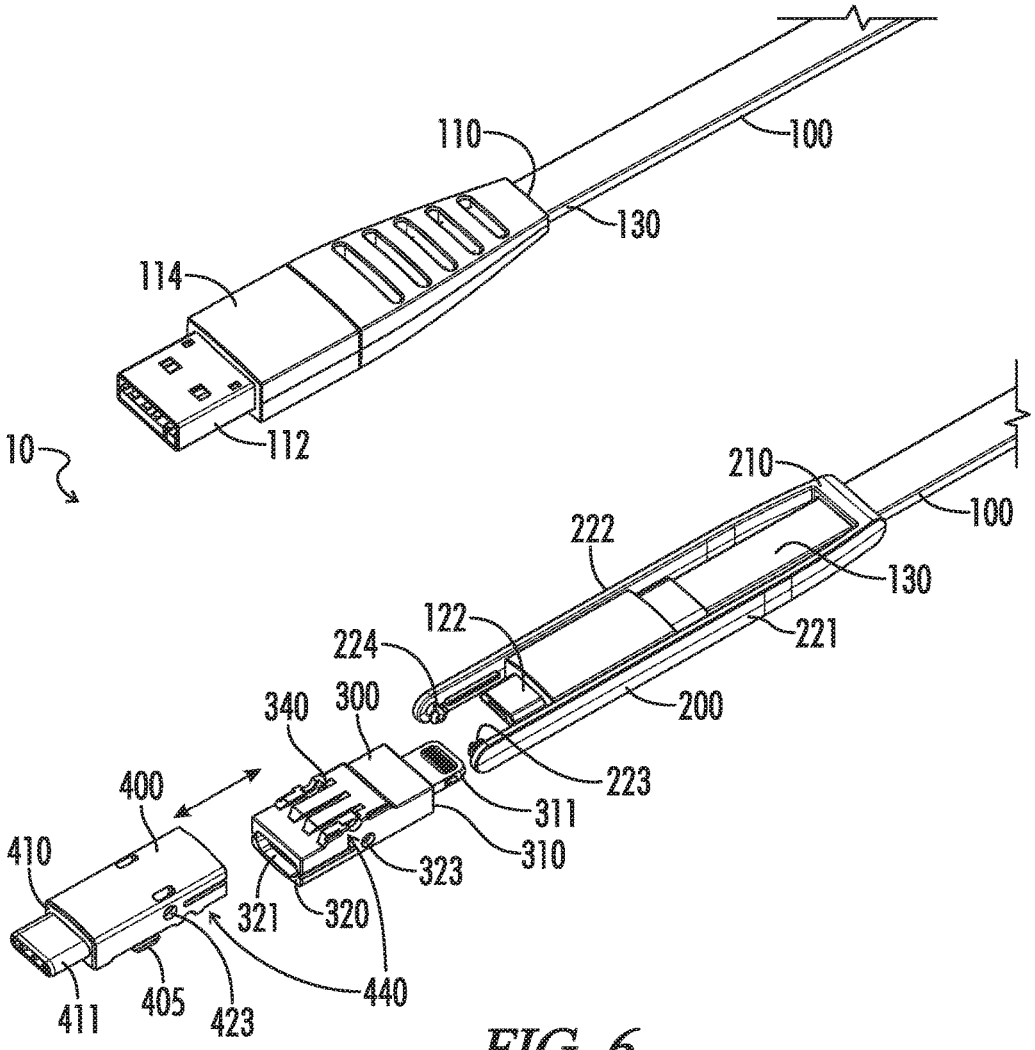
FIG. 6 is a perspective view of the multi-configurable electrical cable assembly of FIG. 1A-C as depicted in FIG. 5, wherein the electrical connector adaptors of the adaptor module are uncoupled/unlocked from one another and uncoupled from the yoke and the yoke is in the connected position (though the adaptor module is not actually connected to the mating connector).
Figure 7:
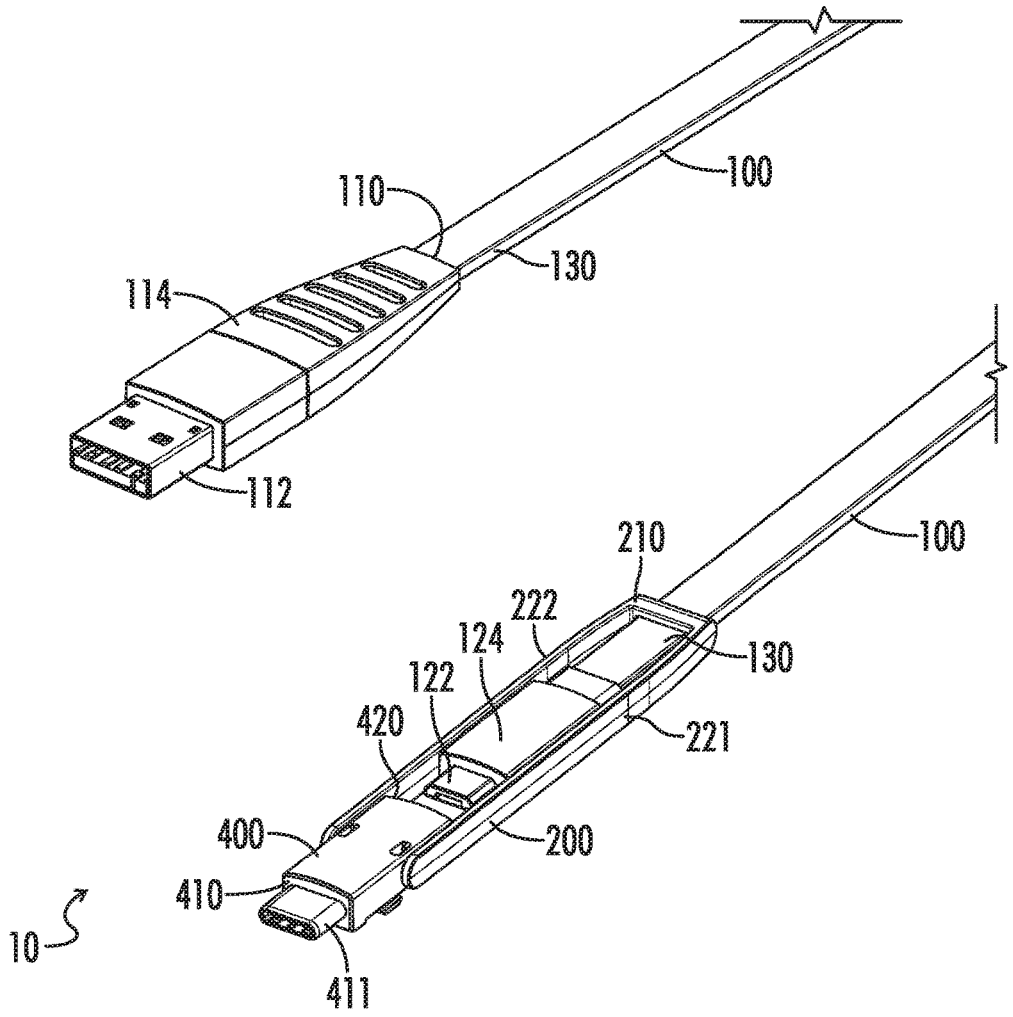
FIG. 7 is a perspective view of a multi-configurable electrical cable assembly in accord to that depicted in FIGS. 1-6, wherein the yoke is depicted in an unconnected extended position and the electrical connector adaptor is detached from the mating connector at the end of the cable. The adaptor module in this configuration is comprised of a single electrical connector adaptor.
Figure 8:
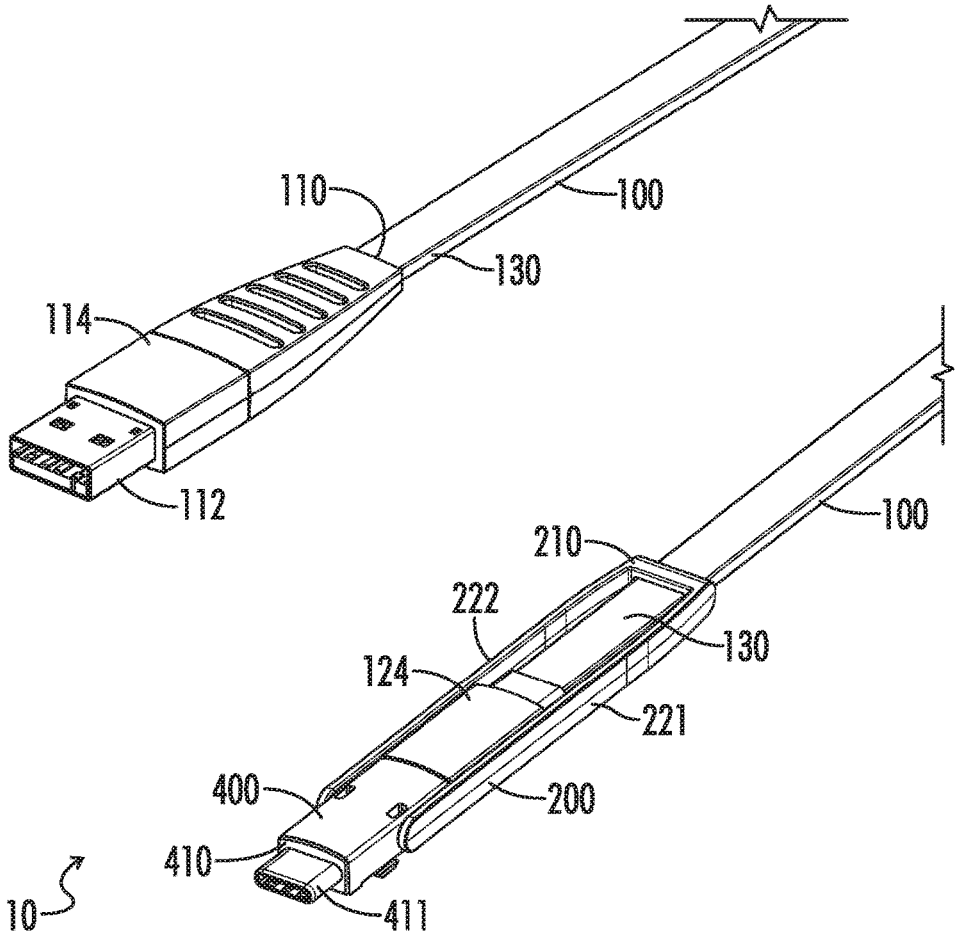
FIG. 8 is a perspective view of the multi-configurable electrical cable assembly depicted in FIG. 7, wherein the yoke is depicted in a connected position and the electrical connector adaptor is attached to the mating connector at the end of the cable.
Figure 9:
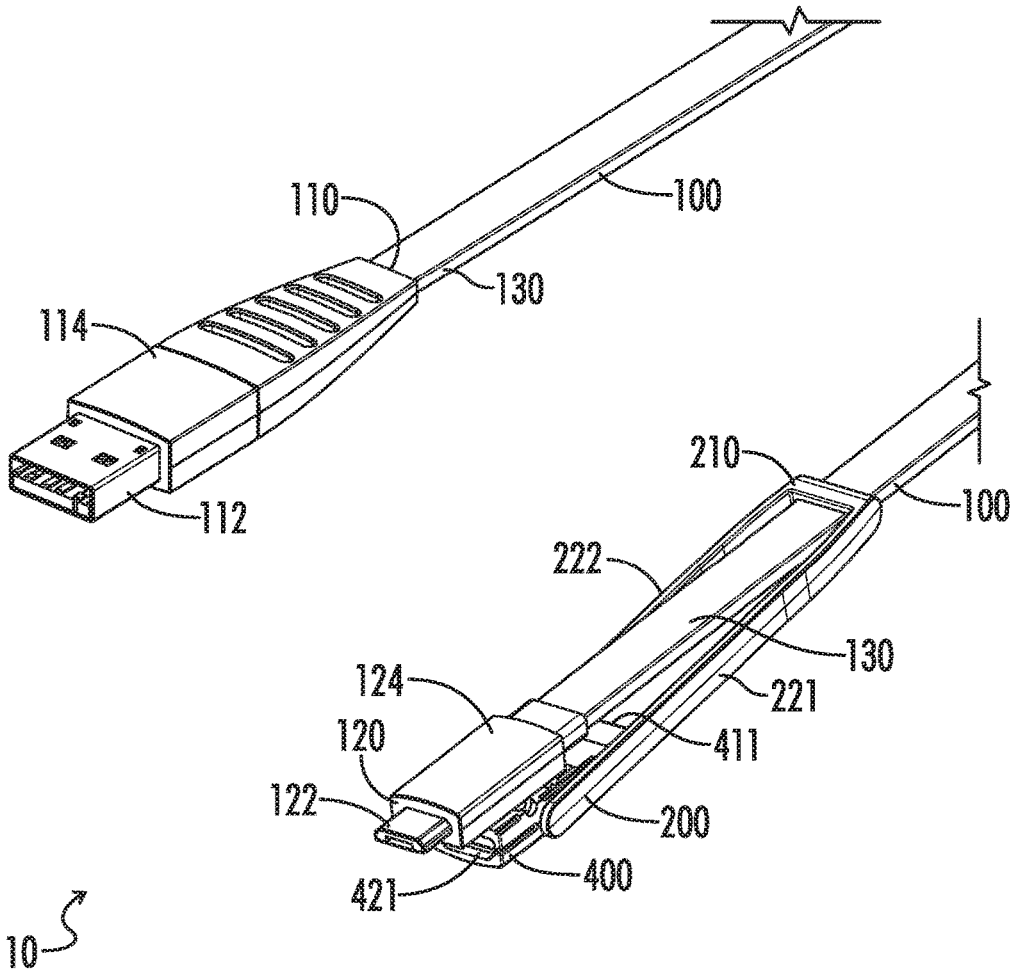
FIG. 9 is a perspective view of the multi-configurable electrical cable assembly depicted in FIG. 7, wherein the yoke is depicted in an unconnected retracted position and the electrical connector adaptor is detached from the mating connector at the end of the cable and is rotated approximately 180 degrees.

As set forth above, disclosed in FIGS. 1-9 is a multi-configurable electrical cable assembly 10 adapted to facilitate communication with and supplying power to electronic devices. The cable assembly generally comprises a cable 100, a yoke 200 captively and slidably coupled to the cable at one end and rotatably coupled to an adaptor module 500 at the other end. The adaptor module 500 includes one or more electrical connector adaptors 300, 400. The yoke 200 can be extended or retracted along the cable 100 to facilitate connection of the electrical connector adaptors 300, 400. When the yoke 200 is in an unconnected, extended position, the adaptor module 500 is rotatable to allow for selection of a desired electrical connector adaptor 300, 400 for connection to the cable. FIGS. 1-6 depicts a cable assembly 10 configuration wherein the adaptor module 500 is comprised of two electrical connector adaptors 300 and 400, whereas FIGS. 7-9, depicts a cable assembly 10 configuration wherein the adaptor module 500 includes only a single electrical connector adaptor 400. Each of these components is discussed below in more detail.

The cable 10 extends from a first end 110 to a second end 120. The first end 110 terminates at a first electrical connector 112 and the second end 120 terminates at a second electrical connector 122. In the implementation illustrated, the first electrical connector 112 is USB Type A male connector and the second electrical connector 122 is a USB micro male connector. The first and second electrical connectors 112, 122 are housed within respective overmold housings 114, 124 that serve to protect and secure the electrical connectors to the cable 10. The first and second electrical connectors 112 and 122 are coupled to one another through one or more conductive pathways 140 (not shown) in the cable 10 that are housed and protected within an external cable jacket 130.

The slidable yoke or sleeve 200 extends from a first end portion 210 to a second end portion 220. The first end portion 210 is comprised of a sleeve that is captively coupled to the cable jacket 130 and dimensioned to slide over the cable jacket 130. The overmold housings 114, 124 are dimensioned to serve as a slide-stop to the yoke 200 on either end of the cable 10. In one implementation the yoke is configured to be detachably coupled to the cable 10. In such an implementation, the sleeve may be configured to only partially encircle the cable jacket 130 and thereby allow insertion and removal of the cable 10 therefrom. The second end portion 220 of the yoke 200 includes a first support structure 221 and a second support structure 222 spaced apart and opposed to one another. Each of the first and second support structures 221, 222 are in the shape of a support arm and include opposed attachment pins 223 and 224 (best illustrated in FIG. 5) on their opposed inward facing surfaces. The attachment pins 223, 224 are dimensioned to be reversibly received in corresponding pivot point apertures 323, 324, 423, 424, 523, 524 on the adaptor module 500 and/or the electrical connector adaptors 300 and 400, which are described in more detail below.

The first electrical connector adaptor 300 includes a housing 305 extending from a first adaptor end 310 to a second adaptor end 320. The first adaptor end 310 includes a third electrical connector 311 and the second adaptor end 320 includes a fourth electrical connector 321. In the illustrated implementation, the first electrical connector adaptor 300 is configured to convert a USB micro connection to a Lightning connection. The third electrical connector 311 is a male lightning connector and the fourth electrical connector 321 is a female USB micro connector adapted to connect to the second electrical connector 122 (which is a male USB micro connector) at the second end 120 of the cable 100. The fourth electrical connector 321 is electrically connected to the third electrical connector 311 via electrical pathways provided within the adaptor housing 305. Thus, when the fourth electrical connector 321 is connected to the second electrical connector 122, the third electrical connector 311 is electrically connected to the first electrical connector 112 at the first end 110 of the cable 100. Pivot point apertures 323, 324 are provided on opposing sides of the first electrical connector adaptor 300 to facilitate independent and direct connection to the corresponding attachment pins 223 and 224 on the yoke 200. Interlocking slide connections 340 located at the mid-region 330 of the housing 305 (best illustrated in FIG. 6) are also provided to facilitate reversible interlocking coupling with corresponding connections 440 on the second electrical connector adaptor 400, as described in additional detail below.

The second electrical connector adaptor 400 is similar to the first electrical connector adaptor 300, and includes a housing 405 extending from a third adaptor end 410 to a fourth adaptor end 420. The third adaptor end 410 includes a fifth electrical connector 411 and the second adaptor 420 end includes a sixth electrical connector 421. In the illustrated implementation, the second electrical connector adaptor 400 is configured to convert a USB micro connection to a USB Type C connection. The fifth electrical connector 411 is a male USB Type C connector and the sixth electrical connector 421, like the fourth electrical connector 321, is a female USB micro connector adapted to connect to the second electrical connector 122 at the second end 120 of the cable 100. The sixth electrical connector 421 is electrically connected to the fifth electrical connector 411 via electrical pathways provided within the adaptor housing 405. Thus, when the sixth electrical connector 421 is connected to the second electrical connector 122, the fifth electrical connector 411 is electrically connected to the first electrical connector 112 at the first end 110 of the cable 100. Pivot point apertures 423, 424 are provided on opposing sides of the second electrical connector adaptor 400 to facilitate independent and direct connection to the corresponding attachment pins 223 and 224 on the yoke 200. Interlocking slide connections 440 located at the mid-region 430 of the housing 405 (best illustrated in FIG. 6) are provided to facilitate reversible interlocking coupling with corresponding connections 340 on the first electrical connector adaptor 300.

The adaptor module 500 is comprised of one or more electrical connector adaptors 300, 400. In FIGS. 1-6, the adaptor module 500 is depicted as being comprised of the first and second electrical connector adaptors 300 and 400 coupled to one another at their respective first and second adaptor mid-regions 330 and 430 via interlocking connections 340/440. As best illustrated in FIG. 6, the interlocking sliding connections 340 and 440 are configured to allow the first and second electrical connector adaptors 300 and 400 to mechanically slide and lock and unlock from one another. The adaptor module 500 is rotatably coupled to said second end portion 220 of the yoke 200 between and by first and second support structure arms 221 and 222. The rotatable coupling is facilitated by the attachments pins 223 and 224 of the support arms 221 and 222 being received within correspondingly dimensioned shared pivot point apertures 523 and 524 on opposing sides of the adaptor module 500.

Alternatively, the attachment pins 223 and 224 may be inserted or plugged into opposing pivot point apertures 323, 324 or 423, 424 on opposing sides of the 1$^{st}$ or 2$^{nd}$ electrical connector adaptor 300, 400. In this regard, it should be understood that the electrical connector adaptors 300 and 400 may be disengaged or de-coupled from one another by disengaging the interlocking slide connections 340 from 440 and the yoke 200 may be rotatably coupled to a single connector adaptor 300 or 400 as illustrated in FIGS. 6-9.

As illustrated in the drawings, in operation, the yoke 200 is configured to be extended and retracted from the cable 100 to facilitate operation of the cable assembly 10. The sleeve of the yoke 200 slides along and is guided by the cable jacket 130 as it is moved from one position to another. When the yoke 200 is extended in an unconnected positions, such as that illustrated in FIGS. 2A, 3, 4 and 7, the adaptor module 500 and/or the electrical connector adaptors 300 and/or 400 may be rotated to allow for the desired selection and alignment of an electrical connector relative to the cable 100. Alternatively, when the yoke 200 is in a retracted unconnected position, such as that illustrated in FIGS. 2B and 9, the adaptor module 500 and the electrical connector adaptors 300 and/or 400 may be positioned over the cable 100 or the electrical connector overmold housing 124 to allow for convenient out of the way storage when not in use. Once the adaptor module 500 and the desired electrical connector adaptor 300, 400 is aligned, the yoke 200 may be slid into a connected position that facilitates connection with the cable connector, such as that best illustrated in FIGS. 1A-1C and 8.

It should be understood that while certain types of electrical connectors (such as USB Type A, USB micro, USB Type C, and Lightning) are illustrated and described herein, any standard, proprietary, or custom computer bus and/or power connector may be used. Moreover, it should be understood that while the first and second electrical cable connectors 112, 122 are in the illustrated implementation are different male connectors, it should be understood that they could be of the same type and/or one of the connectors could be female and the other male (or female/female). Furthermore, it should be understood that while the adaptor module 500 may comprise any number of electrical connector adaptors 300, 400, etc., including one, two, three, four, five, six etc. It should also be understood that the cable assembly 10 disclosed herein can be part of a cable assembly adaptor system that includes additional electrical connector adaptors, adaptor modules, and/or multiple yokes that can be coupled together as described herein to allow a user to customize their cable assembly 10 solution to meet the user's particular needs.

It should also be understood that in some embodiments each end 110, 120 of the cable assembly may be configured to connect to separate slidable yokes 200, 200* (not shown) and electrical connector adaptors 300, 400 or adaptor modules 500. In this way, a user could carry a single cable with multiple adaptors to accomplish all potential connections. For example, the cable 100 may include a male USB type-C first end 110 and a male USB type-C second end 120. A first yoke 200 configured to connect to first end 110 may include a first adaptor module 500 including both a first electrical connector adaptor 300 including a male Lightning first adaptor end 310 and a female USB type-C second adaptor end 320 and a second electrical connector adaptor 400 including a male USB micro first adaptor end 410 and a female USB type-C second adaptor end 420. A second yoke 200* configured to connect to second end 120 may include only a single electrical connector adaptor 300* including a male USB micro first adaptor end 310* and a female USB type-C second adaptor end 320*.

In some embodiments, the yoke 200 and/or the electrical connector adaptors 300, 400 used with a first end 110 may be configured to also fit over and pair with the second end 120. In other embodiments, the yoke 200 and/or the electrical connector adaptors 300, 400 (or adaptor module 500) configured for use with a first end 110 may be constructed or dimensioned differently from the yoke 200* and/or the electrical connector adaptors 300*, 400* (or adaptor module 500*) configured for use with the second end 120 to ensure that users only use an electrical connector adaptor 300 with the appropriate end 110, 120. One method to ensure users do not incorrectly attach the wrong yoke 200, 200* to the wrong end 110, 120 would be to include a thicker cable jacket 130 near a first end 110 and a thinner cable jacket 130 near a second end 120 (or vice versa). Yokes 200 and 200* could be molded with first end portions 210 that pair to only a first end 110 or second end 120. Alternatively, ensuring users connect the electrical connector adaptor 300 to the correct end 110, 120 may be implemented by molding first electrical connector overmold 114 and second electrical connector overmold housing 124 with different shapes, dimensions, or connectors and molding the housings 305, 405 (configured to pair with first electrical connector overmold housing 114) to be different from housings 305*, 405* (configured to pair with second electrical connector overmold housing 124).

In an alternate embodiment, the three-in-one charge/sync cable assembly 10 may include a Y-fork in the cable 100, including the first end as described in previous embodiments, but also including second end 120 including a second electrical connector 122 as well as a third end (not shown) including a third electrical connector (not shown). This sort of Y-embodiment of the three-in-one charge/sync cable 10 may be used as both a connector and a hub, configured to provide power to or communicate data to and from multiple peripherals simultaneously. In this embodiment, the connection point where the three cables 100 meet may include reinforced conductive pathways 140 and reinforced cable jacket 130 to withstand potential rough use. Additional electronic components may be incorporated in the cable assembly 10 to ensure both peripherals are recognized and powered by the master device connected to first end 110.

In some embodiments, cable 100 may include female first electrical connector 110 and female second electrical connector 122. In these or some other embodiments, the electrical connector adaptors 300, 400 may include a male second adaptor end 320, enabling the male second adaptor ends 320 to connect to a female electrical connector 112, 122. In some embodiments, the electrical connector adaptors 300, 400 may include a female first adaptor end 310 and a female second adaptor end 320, enabling the cable to be used as an extension cable or for use with devices including built-in male end plugs. In other embodiments, the electrical connector adaptor 300 may include additional circuitry capable of converting data signals (e.g., an electrical connector adaptor incorporating a SATA III to USB 3.0 bridge between a female USB 3.0 second adaptor end 320 and a male SATA first adaptor end).

Additionally it is noted that the power and data throughput of various standards has increased over time. In some embodiments, the three-in-one charge/sync cable assembly 10 includes conductive pathways 140 optimized for the power and data throughput levels of the highest configurable electrical connector 300 enabled by the cable. In this way, the three-in-one charge/sync cable assembly 10 is backward compatible without sacrificing top-end performance.

It should also be understood that the cable jacket 130, yoke 200, overmold housings 114, 124, or connector housings 305, 405 may be formed of any suitable material, such as a molded thermoplastic elastomer or thermoplastic rubber and/or nylon or other durable polymer. The yoke 200, for example, may be formed as a unitary molded Nylon structure to facilitate snapping on and off the sleeve from the cable jacket 130.

The cable assembly 10 herein described may be readily configured and employed, for example, as a 3-in-1 charging or sync cable. When configured in a USB Type A to USB micro configuration, the USB Type A plug 112 can be used to plug into a USB receptacle of a power source, e.g., a power adaptor plugged into a wall socket, a power bank, or a desktop computer, while the USB micro plug 122 may be used to plug into, for example, a smart phone or camera to facilitate charging or data synchronization. Similarly, when configured in USB Type A to USB Type C configuration (such as that illustrated in FIG. 8), the cable assembly can be used to charge, power or sync data to an Apple MacBook laptop computer. Alternatively, when configured in a USB Type A to Lightning connector configuration (such as that illustrated in FIG. 1), the cable assembly can be used to charge, power or sync data to an Apple iPhone 7 or iPad device. (Apple, MacBook, Lightning, iPhone, and iPad are trademarks of Apple Inc.) The number of combinations and configurations available to the user depends on the number and nature of the electrical connector adaptors provided and the electrical connections at either end of the cable 10.

Each of the foregoing and various aspects, or teachings herein together with those set forth in the claims and described in connection with the cable assemblies described and summarized above or otherwise disclosed herein including the drawings may be combined to form claims for a device, apparatus, system, method of manufacture, and/or use without limitation.

Although the various inventive aspects are herein disclosed in the context of certain implementations, and examples, it will be understood by those skilled in the art that the present invention extends beyond the specifically disclosed embodiments to other alternative embodiments and/or uses of the invention and obvious modifications and equivalents thereof. In addition, while a number of variations of the forgoing aspects have been shown and described in detail, other modifications, which are within their scope will be readily apparent to those of skill in the art based upon this disclosure. It should therefore be also understood that the scope of this disclosure includes the various combinations or sub-combinations of the specific features and aspects of the embodiments disclosed herein, such that the various features, modes of implementation, and other aspects of the disclosed subject matter may be combined with or substituted for one another. Thus, it is intended that the scope of the present invention herein disclosed should not be limited by the particular disclosed embodiments or implementations described above, but should be determined only by a fair reading of claims made in this patent document and any future patent document that relies on this disclosure.

Similarly, this method of disclosure, is not to be interpreted as reflecting an intention that any claim require more features than are expressly recited in that claim. Rather, as the following claims represent, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A multi-configurable electrical cable assembly adapted to facilitate communication with and charging of an electronic device, said cable assembly comprising:

An electrical cable comprising conductive pathways housed within a cable jacket, said cable extending from a first end to a second end, the first end terminating at a first electrical connector that is housed within a first overmold housing and the second end terminating at a second electrical connector that is housed within a second overmold housing, wherein the first and second electrical connectors are coupled to one another through one or more of the conductive pathways;

a slidable yoke extending from a first end portion to a second end portion, the first end portion being captively coupled to the cable jacket, the second end portion being comprised of a first support arm and a second support arm that is spaced apart and opposed to said first support arm, each of said support arms include an attachment pin, the slidable yoke further being dimensioned to move along the cable jacket from an unconnected position to a connected position while retained from sliding off the cable by the first and second overmold housings; and an adaptor module comprising a first electrical connector adaptor and a second electrical connector adaptor, said adaptor module being rotatably coupled to the second end portion of the slidable yoke by the attachment pins of the support arms, wherein the first electrical connector adaptor comprising a first adaptor housing and extending from a first adaptor end to a second adaptor end and having a first adaptor mid-region extending there-between, the first adaptor end terminating at a third electrical connector, the second adaptor end terminating at a fourth electrical connector that is adapted to being connected to said second electrical connector, the third and fourth electrical connectors are mounted to the first adaptor housing and electrically connected to one another by electrical pathways provided within said first adaptor housing, said first adaptor housing includes an interlocking slide connection on its mid-region and pivot point apertures that are positioned on opposing sides of the first adaptor housing, wherein each pivot point aperture is being dimensioned to rotatably receive an attachment pin, wherein the second electrical connector adaptor comprising a second adaptor housing and extending from a third adaptor end to a fourth adaptor end and having a second adaptor mid-region extending there-between, the third adaptor end terminating at a fifth electrical connector, the fourth adaptor end terminating at a sixth electrical connector that is adapted to being connected to said second electrical connector, the fifth and sixth electrical connectors are mounted to the second adaptor housing and electrically connected to one another by electrical pathways provided within said second adaptor housing, said second adaptor housing includes an interlocking slide connection on its mid-region and pivot point apertures that are positioned on opposing sides of the second adaptor housing, wherein each pivot point aperture is being dimensioned to rotatably receive an attachment pin, wherein the first electrical connector adaptor being reversibly coupled to said second electrical connector adaptor via the interlocking slide connections such that said third electrical connector and said fifth electrical connector are on opposing sides of the adaptor module and said fourth electrical connector and sixth electrical connector are on opposing sides of the adaptor module, wherein the first electrical connector being of a different type than the second electrical connector, the third electrical connector being of a different type than the fourth electrical connector, the fifth electrical connector being different than the sixth electrical connector, and the second electrical connector, the fourth electrical connector, and the sixth electrical connector being of the same type, wherein the second electrical connector being in the form of a male plug and the fourth and sixth electrical connector each being in the form of a female jack, and wherein when the slidable yoke is in the unconnected position, the adaptor module is free to rotate about the attachment pins of the support arms of the slidable yoke allowing for selection of the desired electrical connector adaptor for connection to the second electrical connector, when slidable yoke is in the connected position, the adaptor module is connected to the second electrical connector via either the first or second electrical connector adaptor.

2. The multi-configurable electrical cable assembly of claim 1 wherein said first electrical connector is a USB type A connector.

3. The multi-configurable electrical cable assembly of claim 1 wherein said second electrical connector is a micro USB connector.

4. The multi-configurable electrical cable assembly of claim 1 wherein said third electrical connector is a Lightning eight pin connector.

5. The multi-configurable electrical cable assembly of claim 1 wherein said fifth electrical connector is a USB type C connector.

6. The multi-configurable electrical cable assembly of claim 1 wherein said second end portion of said slidable yoke comprises a sleeve that is dimensioned to receive and slide-over said cable jacket but not the first or second overmold housings.

7. The multi-configurable electrical cable assembly of claim 1 wherein said second end portion of said slidable yoke comprises a sleeve that is dimensioned to removably attach to said cable jacket.

8. The multi-configurable electrical cable assembly of claim 1 wherein the attachment pin on said first support arm and the attachment pin on said second support arm are biased toward each other when attached via the apertures to the adaptor module or either the first or second electrical connector adaptors.

9. The multi-configurable electrical cable assembly of claim 1 wherein the adaptor module includes a first and second shared aperture being positioned on opposing sides of the adaptor module, said first and second share apertures being defined between said first and second electrical connector adaptors and wherein said shared apertures are dimensioned to detachably receive and retain the attachment pins on said first support arm and said second support arms.

10. The multi-configurable electrical cable assembly of claim 1 wherein said first adaptor housing comprises thermo plastic elastomer molded around said third and fourth electrical connectors and said second adaptor housing comprises thermo plastic elastomer molded around said fifth and sixth electrical connectors.

11. A multi-configurable electrical cable assembly adapted to facilitate communication with and charging of an electronic device, said cable assembly comprising:

an electrical cable extending from a first electrical connector to a second electrical connector;

a slidable yoke that extends from a first end portion to a second end portion, wherein said first end portion is captively coupled to the external surface of the cable; and an adaptor module comprising a first electrical connector adaptor and a second electrical connector adaptor, said adaptor module being rotatably coupled to the second end portion of the slidable yoke, wherein said first electrical connector adaptor is aligned for connection to said second electrical connector when said adaptor module is rotated to a first position and said second electrical connector adaptor is aligned for connection to said second electrical connector when said adaptor module is rotated to a second position different from said first position.

12. The multi-configurable electrical cable assembly of claim 11 wherein said adaptor module reversibly rotatably coupled to the second end portion of the slidable yoke.

13. The multi-configurable electrical cable assembly of claim 11 wherein said first portion is reversibly coupled to the external surface of the cable.

14. The multi-configurable electrical cable assembly of claim 11 wherein said first portion includes a sleeve dimensioned to receive and slide along said cable.

15. The multi-configurable electrical cable assembly of claim 11 wherein said first and second electrical connector adaptors are reversibly connected to one another.

16. The multi-configurable electrical cable assembly of claim 11 wherein said first and second electrical connector adaptors are permanently connected to one another.

17. The multi-configurable electrical cable assembly of claim 11 wherein said first and second electrical connector adaptors are individually configured to being rotatably coupled to the second end portion of the slidable yoke.

18. A multi-configurable electrical cable assembly adapted to facilitate communication with and charging of an electronic device, said cable assembly comprising:

an electrical cable extending from a first electrical connector to a second electrical connector;

a slidable yoke that extends from a first end portion to a second end portion, wherein said first end portion is captively coupled to the external surface of the cable; and a first electrical connector adaptor and a second electrical connector adaptor rotatably coupled to the second end portion of the slidable yoke, wherein said first electrical connector adaptor is aligned for connection to said second electrical connector when rotated to a first position and when rotated to a second position that is different from said first position said first electrical connector adaptor is not aligned for connection to said second electrical connector.

19. The multi-configurable electrical cable assembly of claim 18 wherein said first and second position are degrees in rotation apart.

20. A method of manufacturing a multi-configurable electrical cable assembly adapted to facilitate communication with and charging of an electronic device, said cable assembly comprising:

providing an electrical cable comprising conductive pathways housed within a cable jacket, said cable extending from a first end to a second end, the first end terminating at a first electrical connector that is housed within a first overmold housing and the second end terminating at a second electrical connector that is housed within a second overmold housing, wherein the first and second electrical connectors are coupled to one another through one or more of the conductive pathways;

providing a slidable yoke extending from a first end portion to a second end portion having a first support arm and a second support arm that is spaced apart and opposed to said first support arm, each of said support arms include an attachment pin;

captively coupling the first end portion to the cable jacket;

dimensioning the slidable yoke to allow for guided movement along the cable jacket from an unconnected position to a connected position;

dimensioning the first and second overmold housings to stop the first end portion from sliding off the cable;

providing a first electrical connector adaptor comprising a first adaptor housing and extending from a first adaptor end to a second adaptor end and having a first adaptor mid-region extending there-between, the first adaptor end terminating at a third electrical connector, the second adaptor end terminating at a fourth electrical connector that is adapted to being connected to said second electrical connector, the third and fourth electrical connectors are mounted to the first adaptor housing and electrically connected to one another by electrical pathways provided within said first adaptor housing, said first adaptor housing includes an interlocking slide connection on its mid-region and pivot point apertures that are positioned on opposing sides of the first adaptor housing, wherein each pivot point aperture is being dimensioned to rotatably receive an attachment pin;

providing a second electrical connector adaptor comprising a second adaptor housing and extending from a third adaptor end to a fourth adaptor end and having a second adaptor mid-region extending there-between, the third adaptor end terminating at a fifth electrical connector, the fourth adaptor end terminating at a sixth electrical connector that is adapted to being connected to said second electrical connector, the fifth and sixth electrical connectors are mounted to the second adaptor housing and electrically connected to one another by electrical pathways provided within said second adaptor housing, said second adaptor housing includes an interlocking slide connection on its mid-region and pivot point apertures that are positioned on opposing sides of the second adaptor housing, wherein each pivot point aperture is being dimensioned to rotatably receive an attachment pin;

forming an adaptor module comprising the first electrical connector adaptor and the second electrical connector adaptor by reversibly coupling the first electrical connector adaptor to the said second electrical connector adaptor via the interlocking slide connections such that said third electrical connector and said fifth electrical connector are on opposing sides of the adaptor module and said fourth electrical connector and sixth electrical connector are on opposing sides of the adaptor module; and rotatably coupling said adaptor module to the second end portion of the slidable yoke by the attachment pins of the support arms such that when the slidable yoke is in the unconnected position, the adaptor module is free to rotate about the attachment pins of the support arms of the slidable yoke allowing for selection of the desired electrical connector adaptor for connection to the second electrical connector and when the slidable yoke is in the connected position, the adaptor module is connected to the second electrical connector via either the first or second electrical connector adaptor, wherein said first electrical connector being of a different type than said second electrical connector, said third electrical connector being of a different type than said fourth electrical connector, said fifth electrical connector being different than said sixth electrical connector, and said second electrical connector, fourth electrical connector, and sixth electrical connector each being of the same type, and wherein the second electrical connector being in the form of a male plug and the fourth and sixth electrical connector each being in the form of a female jack.

21. A multi-configurable electrical cable assembly adapted to facilitate charging of an electronic device, said cable assembly comprising:

a cable having a first end and a second end;

a first electrical connector plug of a first type attached at the first end of the cable;

a second electrical connector plug of a second type, different that the first type, attached at the second end of the cable;

a support structure comprising a cable sleeve configured to at least partially encircle and slide along and over the cable;

a first adaptor having a first electrical connector jack on one side and a third electrical connector plug on another side that are electrically coupled to each other, said first electrical connector jack being configured to connect to the second electrical connector plug; and a second adaptor having a second electrical connector jack on one side and a fourth electrical connector plug on another side that is electrically coupled to each other, said second electrical connector jack being configured to connect to the second electrical connector plug, wherein the first and second adaptors are rotatably coupled to and lockable to the support structure by a locking mechanism configured to maintain the adaptors in aligned position for connection with said second electrical plug.

* * * * *